US007946270B2

(12) United States Patent
Osumi et al.

(10) Patent No.: US 7,946,270 B2
(45) Date of Patent: May 24, 2011

(54) VALVE APPARATUS

(75) Inventors: Hidetoshi Osumi, Nagoya (JP); Katsuya Torii, Anjo (JP)

(73) Assignee: Denso Corporation, Kariya (JP)

( * ) Notice: Subject to any disclaimer, the term of this patent is extended or adjusted under 35 U.S.C. 154(b) by 427 days.

(21) Appl. No.: 12/184,504

(22) Filed: Aug. 1, 2008

(65) Prior Publication Data

US 2009/0188462 A1 Jul. 30, 2009

(30) Foreign Application Priority Data

Aug. 3, 2007 (JP) ..... 2007-203066

(51) Int. Cl.
*F02D 9/10* (2006.01)

(52) U.S. Cl. ..... 123/337; 123/306; 123/399; 251/305

(58) Field of Classification Search ..... 123/306, 123/337, 399; 251/305
See application file for complete search history.

(56) References Cited

U.S. PATENT DOCUMENTS

| | | | | |
|---|---|---|---|---|
| 2003/0052296 | A1 * | 3/2003 | Minegishi | 251/305 |
| 2007/0017473 | A1 | 1/2007 | Kondo et al. | |
| 2008/0029060 | A1 * | 2/2008 | Ikeda et al. | 123/337 |

FOREIGN PATENT DOCUMENTS

| | | |
|---|---|---|
| GB | 2 393 218 | 3/2004 |
| JP | 62-038436 | 3/1987 |
| JP | 2004-052733 | 2/2004 |

OTHER PUBLICATIONS

Japanese Office Action dated Jul. 28, 2009, issued in corresponding Japanese Application No. 2007-203066, with English translation.

* cited by examiner

*Primary Examiner* — Erick Solis
(74) *Attorney, Agent, or Firm* — Nixon & Vanderhye PC

(57) ABSTRACT

A valve apparatus includes a valve shaft, a body, a bearing housing, a fixing device, and an actuator. The body has a flow path therein, and the flow path has an opening degree that is operated by rotation of the valve shaft. The bearing housing rotatably supports the valve shaft, and the bearing housing has a predetermined attachment portion. The fixing device fixes the bearing housing to the body by fastening the predetermined attachment portion of the bearing housing to an outer surface of the body. The actuator is provided to cover the fixing device from outside, and the actuator is fixed to the body and the bearing housing. The actuator applies a driving force to the valve shaft.

4 Claims, 4 Drawing Sheets

VALVE APPARATUS

CROSS REFERENCE TO RELATED APPLICATION

This application is based on and incorporates herein by reference Japanese Patent Application No. 2007-203066 filed on Aug. 3, 2007.

BACKGROUND OF THE INVENTION

1. Field of the Invention

The present invention relates to a valve apparatus.

2. Description of Related Art

Conventionally, an air intake apparatus has been known as the above valve apparatus, and the air intake apparatus includes an intake manifold, a valve element, a valve shaft, a bearing housing, and an actuator, for example. The intake manifold serves as a body, and the valve element is provided inside the intake manifold to open and close a predetermined flow path. The valve shaft rotates the valve element, and the bearing housing rotatably support the valve shaft. The actuator applies a driving force to the valve shaft.

In a conventional valve apparatus 100 as the air intake apparatus, as shown in FIG. 4, fixing means 101, such as a bolt, fixes a bearing housing 103 on an outer surface of a body 102, and further, similar fixing means 104 fixes an actuator 105 to the bearing housing 103. It should be noted that the predetermined flow path, which is opened and closed by a valve element, is a flow path that generates a vortex flow in intake air based on the operation for reducing the opening of the flow path, for example.

It is required that the bearing housing 103 be not easily detached or removed from the body 102 in order to limit misalignment of the valve shaft. According to the above conventional valve apparatus 100, in order to prevent the easy-detachment of the bearing housing 103, the fixing means 101 may be covered by a potting material, and also the fixing means 101 may be provided with a tamper-proof threaded member.

However, both of (a) the covering of the fixing means 101 by using the potting material and (b) the use of the tamper-proof threaded member may lead to an increase in cost. Thus, due to the need for reduction in cost, there is needed another technique for limiting the detachment of the bearing housing 103. Also, the bearing housing 103 may be needlessly detached in a case, where the actuator 105 is detached for repair. Thus, there should be a countermeasure for limiting the needless detachment.

It should be noted that JP-A-2004-124933 corresponding to GB2393218 discloses an air intake apparatus, which includes a protection member and an actuator. The protection member is disclosed as a guide member 70, and is named as a bearing housing hereinafter. The bearing housing functions as the valve shaft and also covers a bearing from outside thereof to protect the bearing. The actuator covers the bearing housing from outside thereof. According to the air intake apparatus, the bearing housing is rigidly fixed and provided in a state, where the bearing housing is provided between the intake manifold and the actuator, and where the actuator is secured to the intake manifold by a screw. Thus, when the screw is removed in order to detach the actuator, the bearing housing is also released from the rigid state, where the bearing housing is rigidly fixed, thereby the valve shaft may be misaligned disadvantageously.

SUMMARY OF THE INVENTION

The present invention is made in view of the above disadvantages. Thus, it is an objective of the present invention to address at least one of the above disadvantages.

To achieve the objective of the present invention, there is provided a valve apparatus, which includes a valve shaft, a body, a bearing housing, a fixing device, and an actuator. The body has a flow path therein, and the flow path has an opening degree that is operated by rotation of the valve shaft. The bearing housing rotatably supports the valve shaft, and the bearing housing has a predetermined attachment portion. The fixing device fixes the bearing housing to the body by fastening the predetermined attachment portion of the bearing housing to an outer surface of the body. The actuator is provided to cover the fixing device from outside, and the actuator is fixed to the body and the bearing housing. The actuator applies a driving force to the valve shaft.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

First Embodiment

Figure 1:
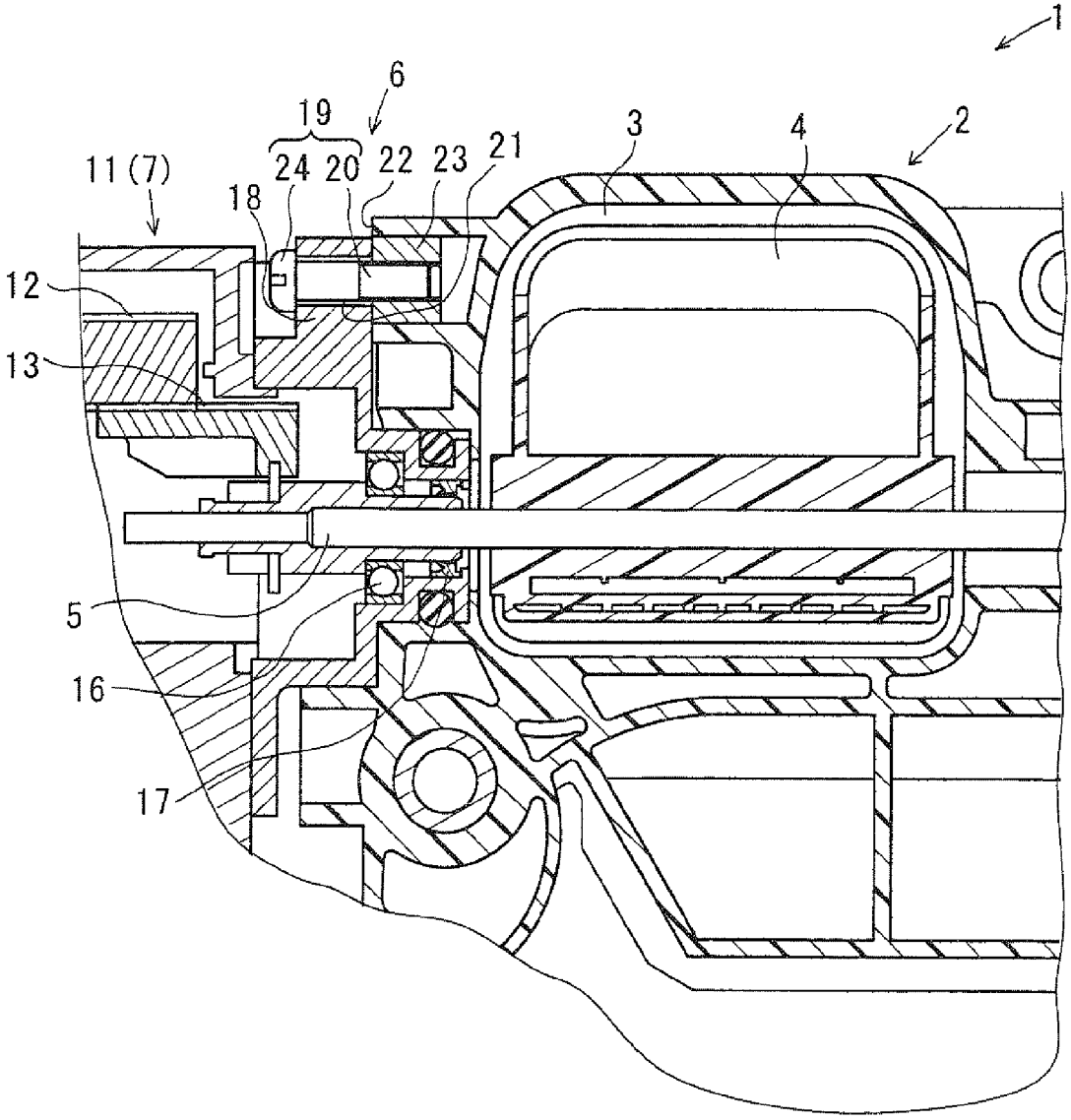
FIG. 1 is a cross-sectional view of a part of an air intake apparatus according to a first embodiment of the present invention.
Figure 2A:
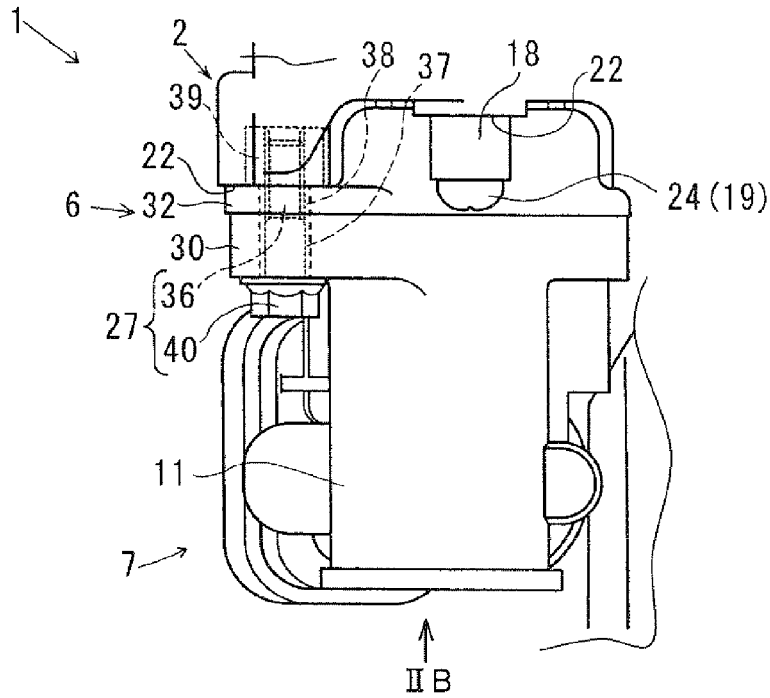
FIG. 2A is a plan view showing the other part of the air intake apparatus.
Figure 2B:
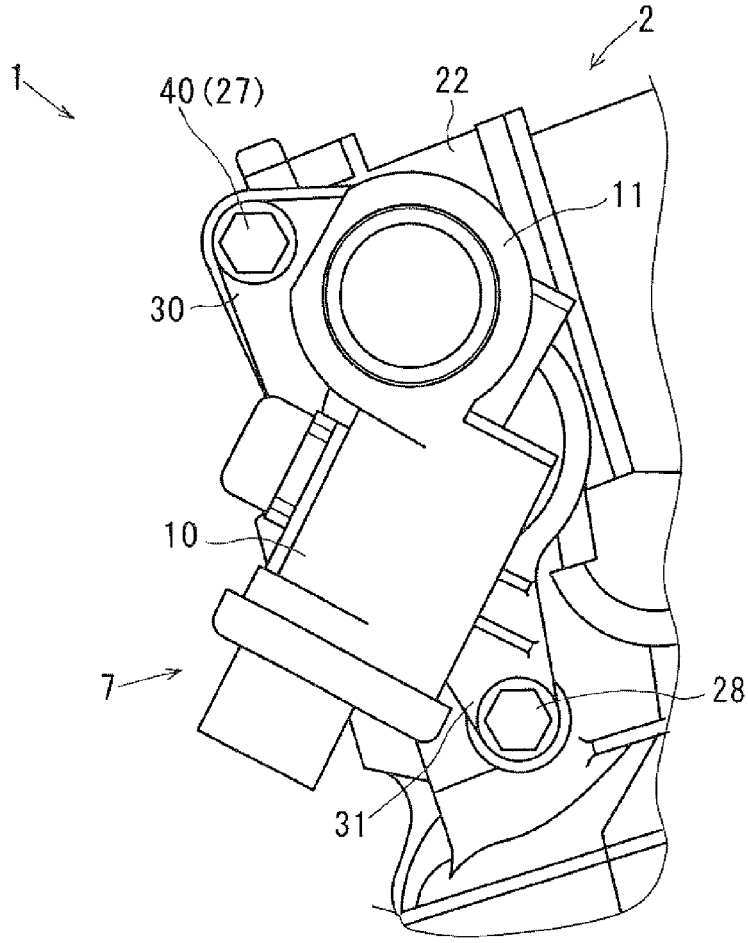
FIG. 2B is a side view showing the other part of the air intake apparatus viewed in a direction IIB of FIG. 2A.
Figure 3:
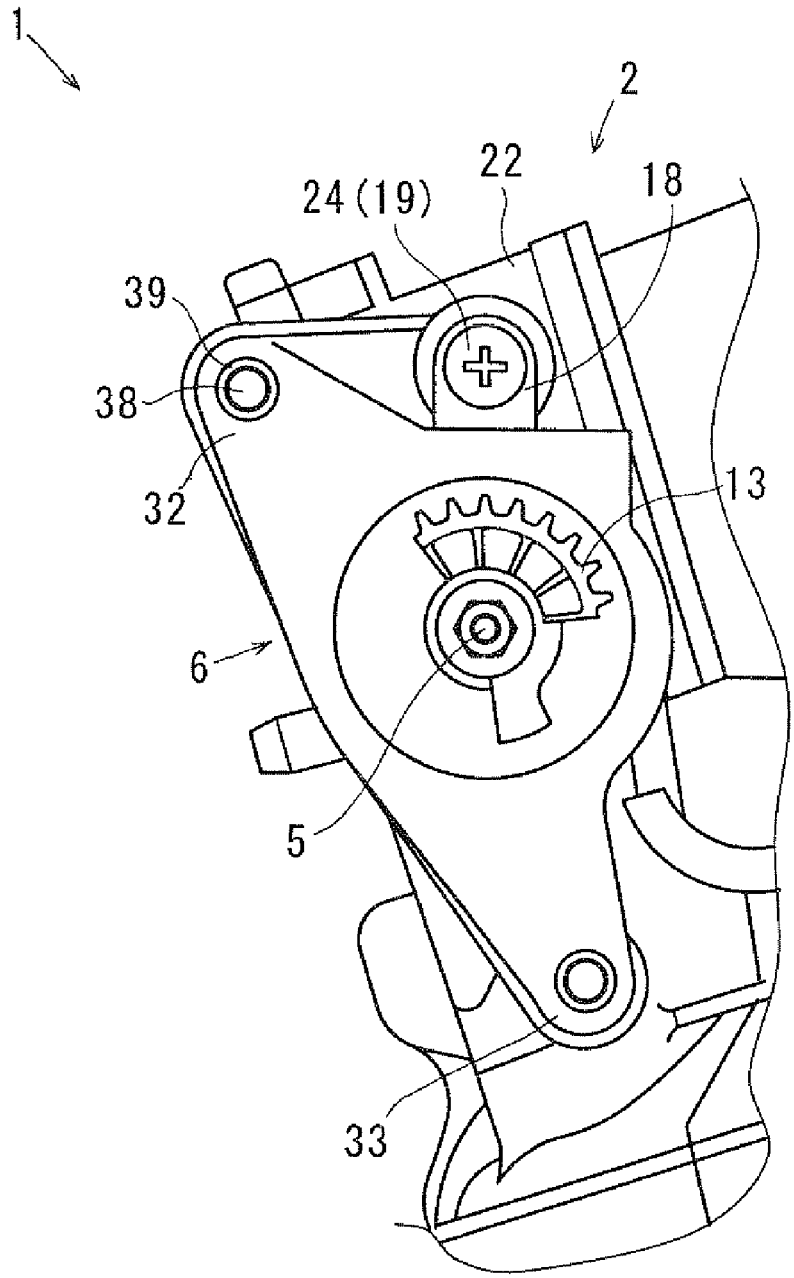
FIG. 3 is a side view showing the other part of the air intake apparatus when the actuator is detached.
Figure 4:
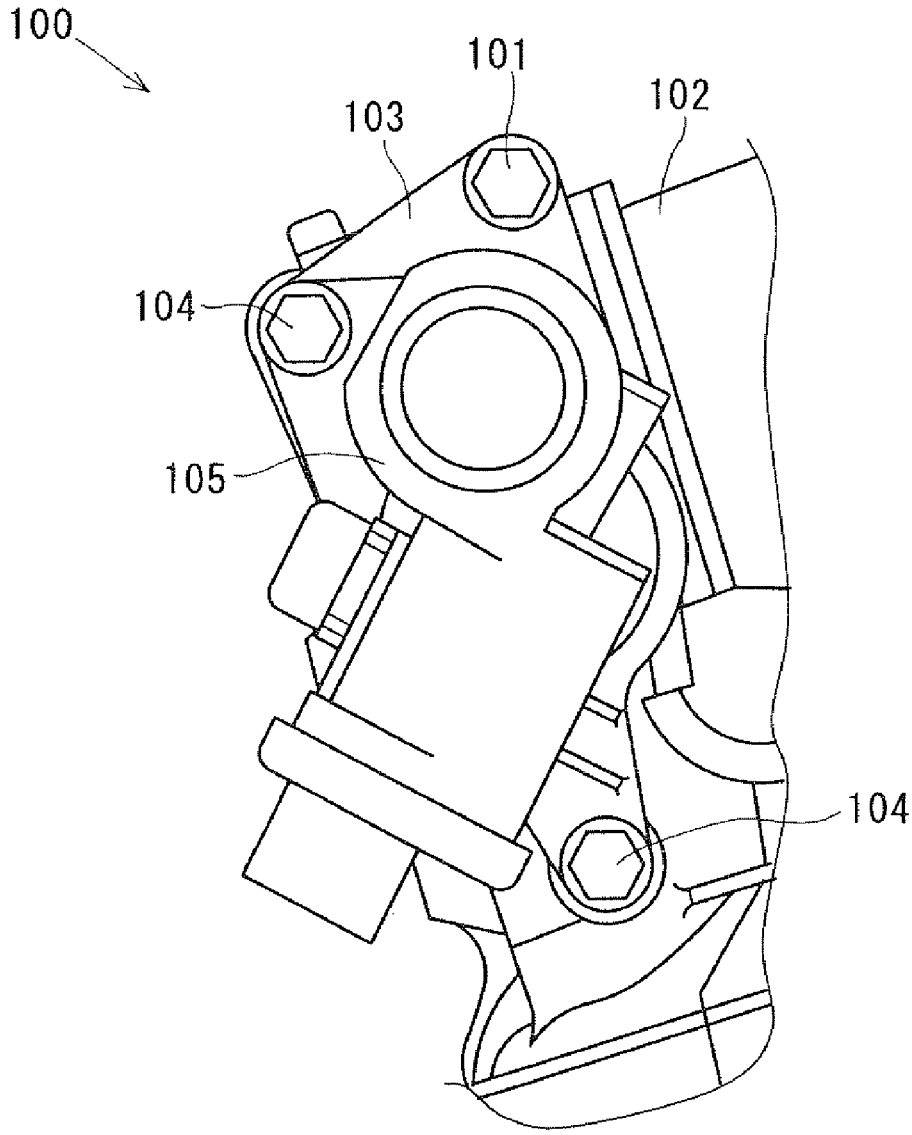
FIG. 4 RELATED ART
FIG. 4 is a side view showing a part of a conventional air intake apparatus.

A valve apparatus 1 according to the first embodiment of the present invention will be described with reference to FIGS. 1 to 3.

The valve apparatus 1 includes an intake manifold 2, a valve element 4, a valve shaft 5, a bearing housing 6, and an actuator 7, for example. The intake manifold 2 serves as a body of the valve apparatus 1 and internally defines a predetermined flow path 3. The valve element 4 is provided inside the intake manifold 2 to open and close the flow path 3, and the valve element 4 is rotated by the valve shaft 5. The bearing housing 6 rotatably supports the valve shaft 5, and the actuator 7 applies a driving force to the valve shaft 5. Thus, the valve apparatus 1 serves as an air intake apparatus, which supplies intake air to a combustion chamber of an engine. Hereinafter, the valve apparatus 1 is named as an air intake apparatus 1. In the above structure, the flow path 3, which is opened and closed by the valve element 4, is provided to generate a vortex flow in intake air by an operation for reducing the opening degree of the flow path 3, for example.

Also, the actuator 7 includes an electric motor portion 10 and a reduction mechanism portion 11. The electric motor portion 10 is controlled by an electronic control apparatus (ECU), which is not shown, and the reduction mechanism portion 11 reduces in speed a driving force outputted by the electric motor portion 10 in order to output the reduced driving force. The reduction mechanism portion 11 includes an output gear 12, and the valve shaft 5 is provided with an input gear 13 at one end of the valve shaft 5. By the engagement or the mesh of the output gear 12 with the input gear 13, the driving force is transmitted from the actuator 7 to the valve shaft 5.

The bearing housing 6 includes a bearing 16, an oil seal 17 and an attachment portion 18. The bearing 16 rotatably supports the valve shaft 5, and the oil seal 17 maintains air tightness between an interior and an exterior of the intake manifold 2. The attachment portion 18 is used for the attachment of the bearing housing 6 with the intake manifold 2. Also, the attachment portion 18 includes a through hole 21, through which a shaft portion 20 of a screw 19 extends. The intake manifold 2 has an outer surface 22 toward one end of the intake manifold 2, and the outer surface 22 is provided with a collar 23, into which the shaft portion 20 is screwed. In other words, the shaft portion 20 is threadably to the collar 23, which is mounted on the outer surface 22. The outer surface 22 faces outwardly in an outward direction along the longitudinal axis of the valve shaft 5, for example.

In addition to the above state, where the shaft portion 20 is screwed into the collar 23, the screw 19 has a head portion 24 that presses the attachment portion 18 against or toward the outer surface 22 of the intake manifold 2. Accordingly, the screw 19 fastens the attachment portion 18 to the outer surface 22. As a result, the bearing housing 6 is mounted to the intake manifold 2 in a fixed manner such that the bearing housing 6 partially covers the outer surface 22 from outside. In the above configuration, the bearing housing 6 partially covers the outer surface 22 from a side of the outer surface 22 in the outward direction along the longitudinal axis of the valve shaft 5, for example.

Also, the actuator 7 is provided such that the reduction mechanism portion 11 further covers the head portion 24 from outside, and the actuator 7 is fixed to the intake manifold 2 and the bearing housing 6. In the above configuration, the actuator 7 is fixed through bolts 27, 28. The actuator 7 covers the head portion 24 from a side of the head portion in the outward direction along the longitudinal axis of the valve shaft 5, for example.

In other words, the actuator 7 is provided with attachment portion 30, 31 and the bearing housing 6 is provided with other attachment portions 32, 33 other than the attachment portion 18. In the above, the attachment portions 31, 33 are not shown in the drawings and the configuration of the attachment portions 30, 32 of the actuator 7 and the bearing housing 6 are representatively described in detail below. Also, the attachment portions 30, 32 respectively have through holes 37, 38, through which a shaft portion 36 of the bolt 27 extends as shown in FIG. 2A. The outer surface 22 of the intake manifold 2 is provided with a collar 39, into which the shaft portion 36 is to be screwed. The attachment portion 32 is provided to the outer surface 22, and the attachment portion 30 is provided to an outer side of the attachment portion 32. In the above, the outer side of the attachment portion 32 faces in the outward direction along the longitudinal axis of the valve shaft 5, for example. In the above configuration, the shaft portion 36 is screwed into the collar 39, and the attachment portion 30 is pressed toward the outer surface 22 by using a head portion 40 of the bolt 27. In other words the head portion 40 of the bolt 27 presses the attachment portion 30 in an opposite direction along the longitudinal axis of the valve shaft 5 opposite the outward direction, for example In the above way, the attachment portion 30 is fastened to the attachment portion 32, and the attachment portion 32 is fastened to the outer surface 22. Also, the attachment portion 31 of the actuator 7 and the attachment portion 33 of the bearing housing are provided with through holes similar to the through holes 37, 38. The attachment portion 31 is fastened to the attachment portion 33, and attachment portion 33 is fastened to the outer surface 22 by the bolt 28. Due to the above fastening, the actuator 7 is fixed to the bearing housing 6, and the bearing housing 6 is fixed to the intake manifold 2.

Advantages of the first embodiment will be described. The air intake apparatus 1 of the first embodiment includes the bearing housing 6, the screw 19, and the actuator 7. The bearing housing 6 is attached to the outer surface 22 of the intake manifold 2 and rotatably supports the valve shaft 5. The screw 19 fastens the attachment portion 18 of the bearing housing 6 to the outer surface 22. The actuator 7 is provided to cover the head portion 24 of the screw 19 from outside and is fixed to the intake manifold 2 and the bearing housing 6. Also, the actuator 7 applies the driving force to the valve shaft 5.

In the above way, because the head portion 24 of the screw (first fixing device) 19 is covered by the actuator 7 from outside, it becomes difficult to handle the head portion 24 unless the actuator 7 is removed or detached. Usually, in a process for removing the actuator 7, there is very small possibility for the head portion 24 to be handled after the removal of the actuator 7. Thus, a countermeasure of high cost, such as coating or covering by the potting material, or using the tamper-proof threaded member, is not needed in order to limit the easy removal of the bearing housing 6, and thereby the bearing housing 6 is inexpensively limited from being easily removed.

Also, the air intake apparatus 1 is provided with the bolts (second fixing devices) 27, 28 that fix the actuator 7 to the bearing housing 6 and that fix the bearing housing 6 to the intake manifold 2.

Thus, the bolts 27, 28 simultaneously achieve the fastening of the actuator 7 to the bearing housing 6, and the fastening of the actuator 7 to the intake manifold 2 via the bearing housing 6. Accordingly, the transmission path of the driving force from the actuator 7 to the valve shaft 5 is protected from interfering with other object or moisture because the actuator 7 is fastened to the bearing housing 6. Also, because the actuator 7 is fastened to the intake manifold 2, the actuator 7 is enabled to be reliably held regardless of external vibrations. In the above, the transmission path of the driving force may be defined as an engaging portion or a mesh portion between the output gear 12 and the input gear 13. As above, the bolts 27, 28 solely achieve the protection of the transmission path of the driving force transmitted from the actuator 7 to the valve shaft 5, and the above reliable retention or holding of the actuator 7 simultaneously.

Modification

According to the air intake apparatus 1 of the first embodiment, an entire of the bearing housing 6 is mounted on or attached to the outer surface 22 of the intake manifold 2 as the body. However, it is not limited to the above configuration. For example, the attachment portion 18 of the bearing housing 6 may be solely mounted on the outer surface 22. That is, the attachment portion 18, which is to be provided with the head portion 24 of the screw 19, may be solely mounted on the outer surface 22, and the actuator 7 may cover only the attachment portion 18 from outside.

Also, in the first embodiment, the air intake apparatus 1 is described as the valve apparatus for supplying intake air to the engine. However, the valve apparatus of the present invention may be applicable to other apparatuses other than the air intake apparatus 1.

Additional advantages and modifications will readily occur to those skilled in the art. The invention in its broader terms is therefore not limited to the specific details, representative apparatus, and illustrative examples shown and described.

What is claimed is:

1. A valve apparatus comprising:

a valve shaft;

a body having a flow path therein, the flow path having an opening degree that is operated by rotation of the valve shaft;

a bearing housing that rotatably supports the valve shaft, the bearing housing having a predetermined attachment portion;

a first fixing device that fixes the bearing housing to the body by fastening the predetermined attachment portion of the bearing housing to an outer surface of the body; and an actuator that is provided to cover the first fixing device from outside, the actuator being fixed to the body and to the bearing housing, the actuator applying a driving force to the valve shaft; and a second fixing device that fixes the actuator to the bearing housing, the second fixing device also fixing the bearing housing to the body, wherein:

the first fixing device fixes the bearing housing to the body without fixing the actuator to the bearing housing or to the body.

2. The valve apparatus according to claim 1, wherein:

the body is an intake manifold defining an intake air passage to an engine; and the valve shaft generates a vortex flow in intake air that is supplied to the engine by an operation for reducing the opening degree of the flow path.

3. The valve apparatus according to claim 1, wherein the outer surface of the body faces in a direction along a longitudinal axis of the valve shaft; and the actuator is located on a side of the first fixing device in the direction to cover the first fixing device from outside.

4. The valve apparatus according to claim 1, wherein:

the valve shaft is provided with a valve element that is rotated by the rotation of the valve shaft; and the valve element opens and closes the flow path to change the opening degree of the flow path.

* * * * *